US008189822B2

(12) United States Patent
Jakowski

(10) Patent No.: US 8,189,822 B2
(45) Date of Patent: May 29, 2012

(54) MODULAR, LINE-ARRAY LOUDSPEAKER

(75) Inventor: Steven J. Jakowski, Farmington, MN (US)

(73) Assignee: Robert Bosch GmbH, Stuttgart (DE)

( * ) Notice: Subject to any disclaimer, the term of this patent is extended or adjusted under 35 U.S.C. 154(b) by 413 days.

(21) Appl. No.: 12/487,316

(22) Filed: Jun. 18, 2009

(65) Prior Publication Data

US 2010/0322445 A1 Dec. 23, 2010

(51) Int. Cl.
*H04R 25/00* (2006.01)

(52) U.S. Cl. ..... 381/182; 381/335; 381/386

(58) Field of Classification Search ..... 381/300, 381/304, 305, 87, 332, 335, 336, 182, 186, 381/386, 387, 395; 181/144, 145, 147, 199
See application file for complete search history.

(56) References Cited

U.S. PATENT DOCUMENTS

| | | | | |
|---|---|---|---|---|
| 3,125,181 | A | 3/1964 | Pawlowski | |
| 3,299,206 | A | 1/1967 | Klepper | |
| 4,267,405 | A | 5/1981 | Russell | |
| 4,940,108 | A | 7/1990 | Selby | |
| 4,969,196 | A | 11/1990 | Nakamura | |
| 5,000,286 | A * | 3/1991 | Crawford et al. | 181/145 |
| 5,802,190 | A | 9/1998 | Ferren | |
| 5,900,593 | A | 5/1999 | Adamson | |
| 6,128,395 | A | 10/2000 | De Vries | |
| 6,343,133 | B1 | 1/2002 | Adamson | |
| 6,513,622 | B1 | 2/2003 | Gelow et al. | |
| 6,628,793 | B1 | 9/2003 | Porzilli et al. | |
| 6,628,796 | B2 | 9/2003 | Adamson | |
| 6,640,924 | B2 * | 11/2003 | Messner | 181/144 |
| 6,643,379 | B1 | 11/2003 | Onglao | |
| 6,712,177 | B2 | 3/2004 | Ureda | |
| 6,834,113 | B1 | 12/2004 | Liljehag et al. | |
| 6,870,942 | B1 | 3/2005 | Graber | |
| 7,206,427 | B2 | 4/2007 | Simidian, II et al. | |
| 7,260,235 | B1 | 8/2007 | Henricksen et al. | |
| 7,298,860 | B2 * | 11/2007 | Engebretson et al. | 381/386 |
| 7,319,767 | B2 | 1/2008 | Fidlin et al. | |
| 7,336,793 | B2 | 2/2008 | Horbach et al. | |

(Continued)

FOREIGN PATENT DOCUMENTS

| | | |
|---|---|---|
| EP | 1523214 | 4/2005 |

(Continued)

OTHER PUBLICATIONS

JBL Pro—Portable Sound, VRX932LA-1, 12" Two-Way Line Array Loudspeaker System, available online at: <http://www.jblpro.com/products/portablesound/vrx/vrx932la.html>, 2007.

(Continued)

*Primary Examiner* — Huyen D Le
(74) *Attorney, Agent, or Firm* — Michael Best & Friedrich LLP

(57) ABSTRACT

This invention relates to a line-array loudspeaker that is configurable to meet the acoustic requirements of a venue. In one embodiment, the line-array includes a combination of far-field and near-field loudspeaker modules which are selectively fixedly connected to each other. Each module includes a first loudspeaker element and a second loudspeaker element. Each of the first and second elements includes a high-frequency transducer assembly and a low-frequency transducer assembly. The far-field modules and the near-field modules are fixedly connected using a rigging system to provide a smooth and continuous transition from a first splay angle to a second splay.

17 Claims, 10 Drawing Sheets

U.S. PATENT DOCUMENTS

| | | | |
|---|---|---|---|
| 7,415,124 | B2 | 8/2008 | Colich |
| 7,454,029 | B2 | 11/2008 | Andrews |
| 7,454,030 | B2 | 11/2008 | Graber |
| 7,480,389 | B2 | 1/2009 | Ricks et al. |
| 7,516,932 | B2 | 4/2009 | Engebretson et al. |
| 2002/0071580 | A1 | 6/2002 | Engebretson et al. |
| 2005/0178611 | A1 | 8/2005 | Noselli et al. |
| 2005/0180577 | A1 | 8/2005 | Horbach |
| 2005/0259831 | A1 | 11/2005 | Hutt et al. |
| 2006/0169530 | A1 | 8/2006 | Noselli et al. |
| 2007/0092095 | A1 | 4/2007 | Henricksen et al. |
| 2007/0110269 | A1 | 5/2007 | Levitsky |
| 2008/0085026 | A1 | 4/2008 | Engebretson et al. |
| 2008/0085027 | A1 | 4/2008 | Engebretson et al. |
| 2008/0085028 | A1 | 4/2008 | Engebretson et al. |
| 2008/0170735 | A1 | 7/2008 | Engebretson et al. |

FOREIGN PATENT DOCUMENTS

| | | |
|---|---|---|
| EP | 1921890 | 5/2008 |
| JP | 5276591 | 10/1993 |
| JP | 6225379 | 8/1994 |
| JP | 8251686 | 9/1996 |
| JP | 2004064507 | 2/2004 |
| JP | 2007028085 | 2/2007 |
| WO | 98/07297 | 2/1998 |
| WO | 03/032677 | 4/2003 |
| WO | 2008/010138 | 1/2008 |

OTHER PUBLICATIONS

JBL Pro—Portable Sound, VRX928LA, 8" Two-Way Line Array Loudspeaker System, available online at: <http://www.jblpro.com/products/portablesound/vrx/vrx928la.html>, 2007.

JBL Pro—Portable Sound, VRX932LAP, 12" Two-Way Powered Line Array Loudspeaker System, available online at: <http://www.jblpro.com/products/portablesound/vrx/vrx932lap.html>, 2007.

FBT Professional Audio Equipment: Modus, available online at: <http://fbt.it/intranet/Inglese/pae/speaker/Modus/index.asp>, printed Jul. 15, 2008.

FBT Professional Audio Equipment: Modus Sub—Sub A, available online at: <http://fbt.it/intranet/Inglese/pae/speaker/Modus/Modus-Sub/index.asp>, printed Jul. 15, 2008.

FBT Professional Audio Equipment: Modus 40—40A, available online at: <http://fbt.it/intranet/Inglese/pae/speaker/Modus/Modus-40/index.asp>, printed Jul. 15, 2008.

XLC—Electrovoice, available online at: <http://electrovoice.com/productfamilies/11.html>, printed Jun. 30, 2008.

EV, X-Line Compact Linear Array Loudspeaker System, Telex Communications Inc., 2002.

Electro-Voice, X-Line, Loudspeakers, pro sound Catalog, pp. 34-40, 2006.

Search Report, pp. 12-13, No. 1-6, Landon IP, Inc., Jul. 21, 2008.

"Electro-Voice Announces Complete Line of Fixed Installation Loudspeakers", EV Innovation, available at: <http://www.electrovoice.com/pressreleases/755.html>, InfoComm 2008.

* cited by examiner

MODULAR, LINE-ARRAY LOUDSPEAKER

BACKGROUND

Embodiments of the invention relate to line-array loudspeakers or line-arrays. Typically, line-array loudspeakers include a plurality of elements which are either individually coupled to complex rigging systems, or integrated into a single, large enclosure with fixed splay angles that cannot be adjusted.

SUMMARY

In embodiments of the invention, a modular approach to constructing line-array loudspeakers or line-arrays is utilized. Note that the term speaker can be used to refer to an individual device that converts electrical signals to sound waves or a combination of such devices and associated mechanical and electrical components such as an enclosure (for the speaker) and various circuits. Sometimes an individual element that converts electrical signals to sound waves is referred to as a "driver" or a "transducer."

In one particular embodiment, the invention provides a line array that includes a plurality of loudspeaker modules. The loudspeaker modules are of either a first loudspeaker module type or a second loudspeaker module type. The first module type is a far-field or long-throw loudspeaker module and the second module type is a near-field or short-throw loudspeaker module. Each module has an enclosure with two elements, a fixed splay angle, and a single high-order passive crossover circuit (which is sometimes simply referred to as a "crossover"). In embodiments of the invention, an element refers to an assembly of one or more drivers. Each of the two elements also includes a high-frequency driver (or assembly of drivers) and a low-frequency driver (or assembly of drivers). The first and second module types are configured so that they may be contiguously connected to one another such that there is a smooth and continuous transition between a splay angle of the far-field loudspeaker module and a splay angle of the near-field loudspeaker module. The first and second module types are also configured to be connected to additional loudspeaker modules of the same type such that the splay angle between like module types is constant. Far-field and near-field modules can be added to a line-array as necessary to meet the acoustic requirements of a venue.

In another embodiment, the invention provides a modular line-array with multiple elements. The line-array includes a first loudspeaker module having a first loudspeaker element, a second loudspeaker element, and a first crossover circuit, and a second loudspeaker module having a third loudspeaker element, a fourth loudspeaker element, and a second crossover circuit. Each element includes a low-frequency driver assembly and a high-frequency driver assembly. The first loudspeaker module has a first fixed splay angle, the second loudspeaker module has a second fixed splay angle, and a transition from the first splay to the second splay angle is smooth and continuous. The high- and low-frequency driver assemblies of the first, second, third, and fourth loudspeaker elements are driven by a single (or first) amplifier channel, which results in the production of a coherent acoustic wavefront.

In another embodiment, the invention provides a modular line-array loudspeaker with multiple modules and mating junctions (which are explained in greater detail in the detailed description). The loudspeaker includes a first loudspeaker module of a first type having first and second loudspeaker elements. The loudspeaker also includes a second loudspeaker module of a second type having third and fourth loudspeaker elements. The first module has a first included angle and a first splay angle, and the second module has a second included angle and a second splay angle. A first mating junction is configured to contiguously couple the first module to the second module, and a first transition between the first splay angle and the second splay angle is smooth and continuous. A second mating junction is configured to couple the first loudspeaker module to a third loudspeaker module of the first type, and a second transition between the first module and the third module maintains the first splay angle. A third mating junction is configured to couple the second loudspeaker module to a fourth loudspeaker module of the second type, and a third transition between the second module and the fourth module maintains the second splay angle.

In yet another embodiment, the invention provides a line-array loudspeaker designed for use with a rigging assembly. The loudspeaker includes a first loudspeaker module having a low-frequency driver assembly, a high-frequency driver assembly, and a crossover circuit. The first module has an included angle and a first fixed splay angle. The rigging assembly is configured to contiguously couple the first loudspeaker module to a second loudspeaker module, and the first module is configured to provide a smooth and continuous transition from the first splay angle to a splay angle of the second module. The low-frequency driver assembly and the high-frequency driver assembly are driven by a first amplifier channel.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiments of the invention described herein relate to a line-array loudspeaker that can be assembled to meet the acoustic requirements of a venue. In some embodiments, the loudspeaker includes a combination of far-field loudspeaker modules (i.e., a first loudspeaker module type) and near-field loudspeaker modules (i.e., a second loudspeaker module type) which are fixedly connected to one another. In other embodiments, the loudspeaker includes only a single loudspeaker module type (e.g., either far-field modules or near-field modules). Each module includes a first loudspeaker element or sub-module, a second loudspeaker element or sub-module, and a single high-order passive crossover circuit. Although the term 'element' is often used to describe the smallest constituent part of an object, when referring to line-arrays a person having ordinary skill in the art would recognize that the term 'element' can refer to an assembly of components, such as an assembly of high frequency transducers and low-frequency transducers. Additionally, because each element is a discrete component within a larger module, the elements can also be referred to as 'sub-modules'. Each of the first and second elements includes a high-frequency driver assembly and a low-frequency driver assembly. The far-field loudspeaker modules have a first fixed included angle and a first splay angle, and the near-field modules have a second fixed included angle and a second splay angle. The first and second fixed included angles are sometimes referred to as included trapezoidal angles because of the general shape of each loudspeaker module. However, any references herein to an included angle of a module are not meant to limit the module to a specific geometric shape or configuration. The far-field modules and the near-field modules are selectively connected using a rigging system to provide a smooth and continuous transition from the first splay angle to the second splay angle, or a constant splay angle when only a single module type is used. The high-frequency driver assemblies and the low-frequency driver assemblies are driven by a first amplifier channel.

Figure 1:
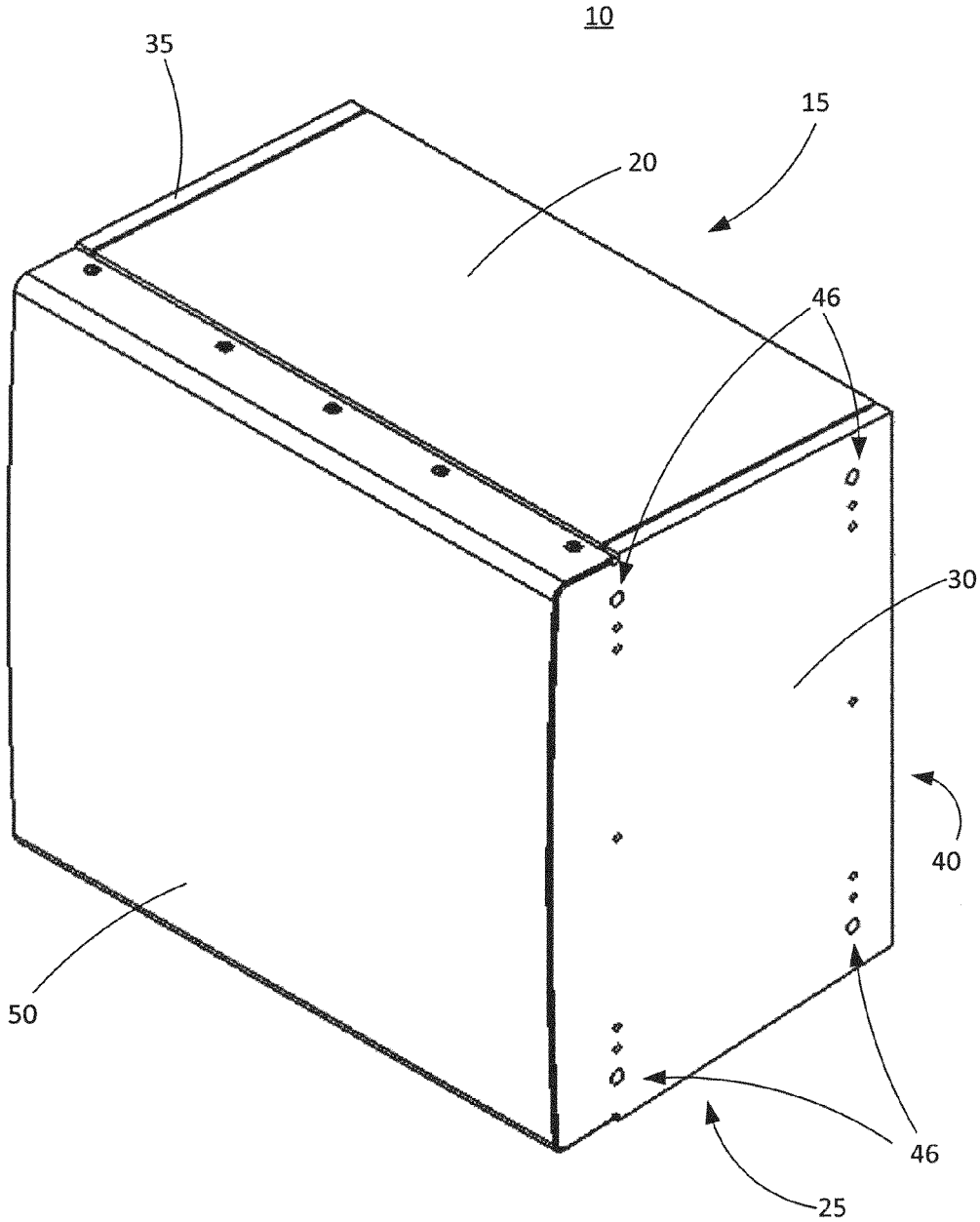
FIG. 1 is a perspective view of a far-field loudspeaker module according to an embodiment of the invention.
Figure 2:
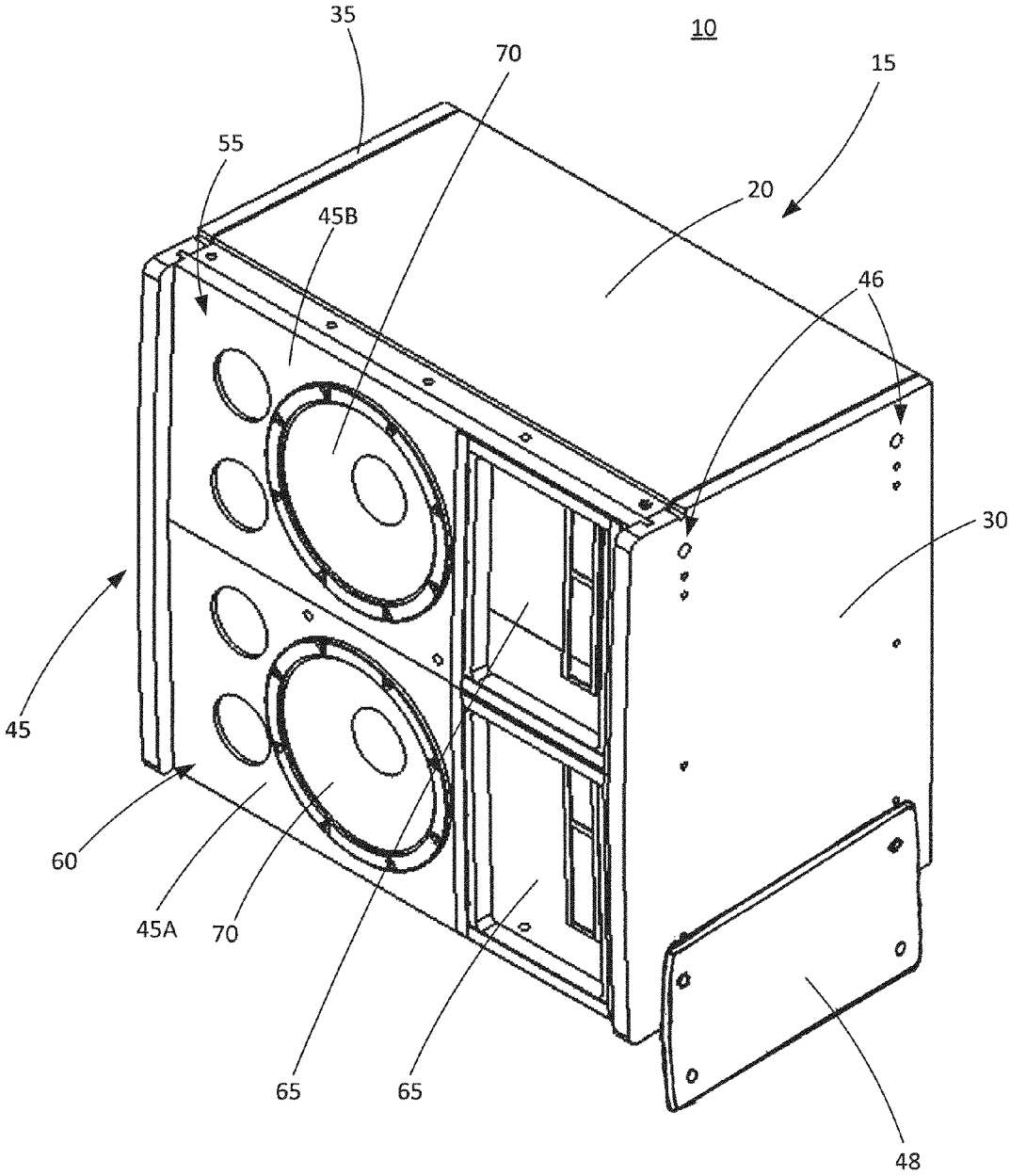
FIG. 2 is the far-field module of FIG. 1 with a speaker grille removed.
Figure 3:
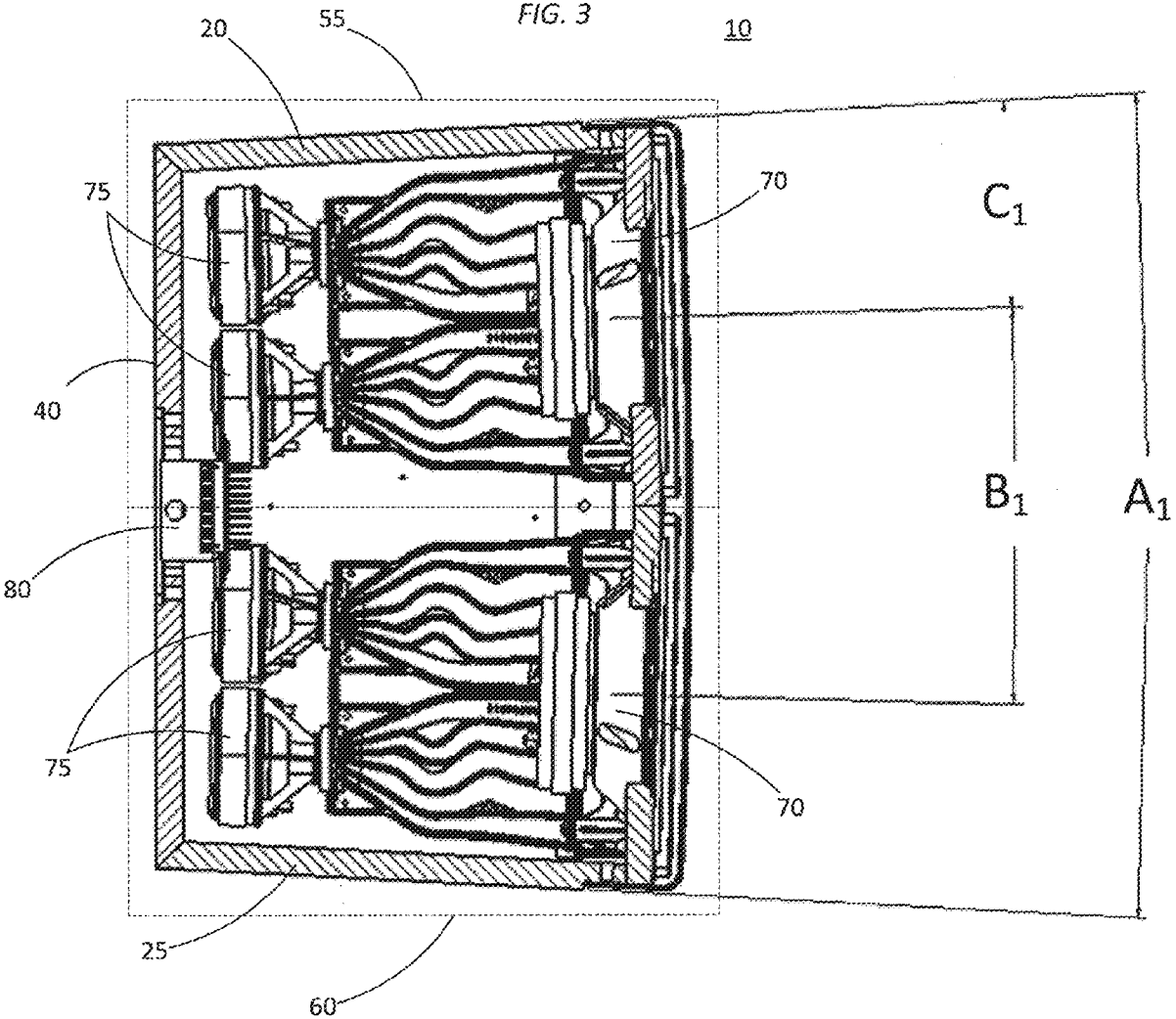
FIG. 3 is a side cross-sectional view of the far-field module of FIG. 1.
Figure 4:
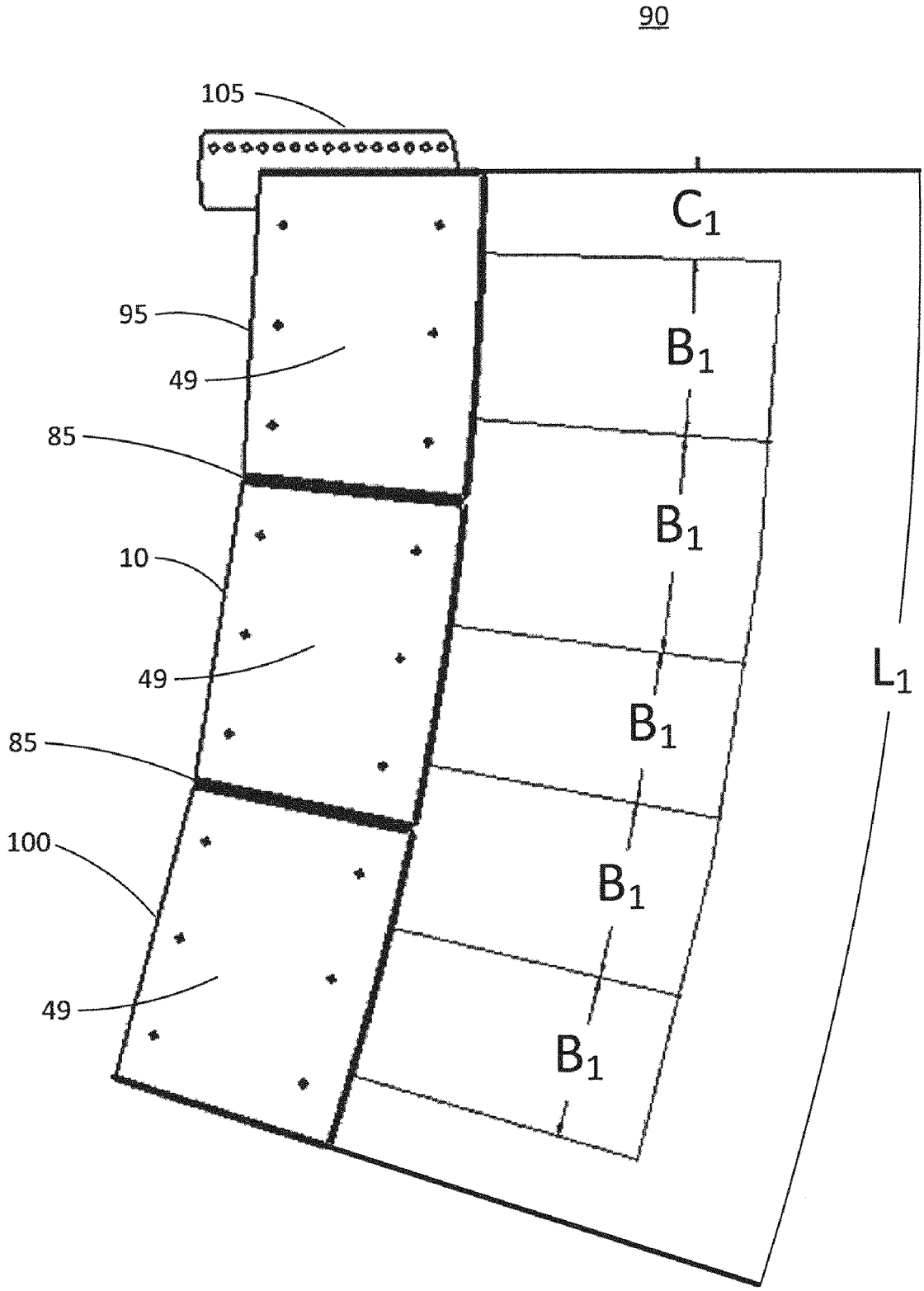
FIG. 4 is a side view of a plurality of far-field loudspeaker modules.

FIGS. 1-3 illustrate a first line-array loudspeaker module 10 of a first loudspeaker module type that includes a module housing 15. The first module type is, for example, a far-field or long-throw loudspeaker module. Far-field loudspeaker modules are used to project sound over long distances, such as to the rear of an auditorium or a hall. The module housing 15 includes a top surface 20, a bottom surface 25, a right surface (from the viewer's perspective) 30, a left surface 35, a rear surface 40, and a front surface 45 (see FIG. 2). The right surface 30 and the left surface 35 include a plurality of mounting points 46 (e.g., recesses, protrusions, threaded fasteners, pins, clips, etc.). The mounting points 46 are configured to receive bolts or other fasteners which are used to connect to a hanging assembly or a plurality of tie plates, such as tie plate 48 to the module housing 15. The tie plates 48 are configured to connect the first loudspeaker module 10 to additional loudspeaker modules. In some embodiments, the tie plates 48 and are made from aluminum. In other embodiments, the tie plates are made from a different material, such as steel. In some embodiments, the tie plates are concealed beneath cover plates 49 (see FIG. 4) to provide a smooth and monolithic appearance to a loudspeaker (i.e., the modules are contiguous and transitions from one module to the next appear continuous). A speaker grille 50 is mounted over the front surface 45 of the module housing 15. In some embodiments, the speaker grille 50 is fastened to the module housing 15 using a plurality of screws or other suitable fasteners. In other embodiments, the speaker grille 50 is removable and is snapped onto or otherwise removably mounted to the module housing 15.

The first module 10 includes a first loudspeaker element 55 and a second loudspeaker or element 60. Each element includes a high-frequency driver or transducer assembly 65 and a low-frequency driver or transducer assembly 70. In some embodiments, each element also includes a mid-frequency driver or transducer assembly, an ultra-high-frequency driver or transducer assembly, and/or an ultra-low-frequency driver or transducer assembly. In other embodiments, each element includes, for example, a high-frequency transducer assembly and a mid-frequency transducer assembly, and the module includes a low-frequency transducer assembly which is common to the first and second elements. The high-frequency driver assembly 65 includes at least one compression driver or high-frequency transducer, and the low-frequency driver assembly 70 includes at least one woofer or low-frequency transducer. In the illustrated embodiment, the high-frequency assembly includes two compression drivers 75 mounted symmetrically with respect to the top and bottom surfaces 20 and 25 of the module housing 15. In other embodiments, the high-frequency assembly includes a ribbon type transducer, a piezo array, or another dedicated high-frequency transducer or transducers. The high- and low-frequency assemblies 65 and 70 are positioned within the first module 10 and are mounted to first and second panels 45A and 45B, respectively, of the front surface 45. As illustrated in FIG. 3, the first module 10 also includes a crossover circuit ("crossover") 80 positioned within the module housing 15 and adjacent to the rear surface 40. In other embodiments, the crossover 80 can be positioned at alternative locations within the module housing 15, such as adjacent to the top surface 20, the bottom surface 25, the right surface 30, or the left surface 35. In some embodiments, the low frequency assemblies 70 share a common acoustical space within the module housing 15. In other embodiments, the module housing 15 is divided internally such that each the low frequency assemblies 70 have separate acoustical spaces. The acoustical space or spaces for the low frequency assemblies 70 are either vented or un-vented. In other embodiments, the acoustical space or spaces have different configurations such as a passive radiator, an acoustic labyrinth, a horn load, or the like.

The first loudspeaker module 10 (i.e., a far-field module) has a first included angle, $A_1$. In one embodiment, the first included angle, $A_1$, is six degrees ("6°"), and a vertical splay angle, $B_1$, (e.g., an angle between the respective radiated acoustic centers of the first and second front panels 45A and 45B of the first and second elements 55 and 60) is one-half the first included angle, $A_1$, or three degrees ("3°"). A first mounting angle, $C_1$, as illustrated in FIG. 3, is the angle between a center of the first or second element 55 or 60 and the top or bottom surface 20 or 25, respectively. In the illustrated embodiment, the mounting angle, $C_1$, has a value that is equal to one-half of the splay angle, $B_1$. As such, the first and second elements 55 and 60 are oriented symmetrically with respect to the top surface 20 and the bottom surface 25 of the module housing 15. In other embodiments, one or more of the high- or low-frequency transducers are not symmetric about the top and bottom surfaces 20 and 25. The first module 10 also includes a horizontal coverage angle of, for example, 90° or 120°. In other embodiments, the first module 10 can have different horizontal coverage angles, such as 60°, 135°, etc.

The first module 10 is connected at first mating junctions 85 to additional loudspeaker modules of the first type using the tie plates. In one embodiment of a line-array loudspeaker 90 (FIG. 4), the first loudspeaker module 10 is connected to a second loudspeaker module 95 and a third loudspeaker module 100. The second and third modules 95 and 100 are each of the first type (e.g., far-field modules). As a result of the symmetrical orientation of the first and second elements of each module (as described above), the combination of the first, second, and third loudspeaker modules 10, 95, and 100 results in a uniform splaying of individual elements throughout an overall vertical splay angle, $L_1$, (i.e., $L_1$ is equal to three $A_1$) for the line-array loudspeaker 90. The mounting angle, $C_1$, is also equal to the angle between the center of a first element of the second module 95 and a hanging assembly 105, and the splay angle, $B_1$, is constant for the combination of the first, second, and third modules 10, 95, and 100. In some embodiments, each of the first, second, and third modules 10, 95, and 100 has the same horizontal coverage angle (e.g., 90°). In other embodiments, the horizontal coverage angles of the first, second, and third modules 10, 95, and 100 are varied to meet the acoustic requirements of a venue. For example, if a rear portion of a room (i.e., an area distant from the loudspeaker) is wider than a front portion or the room (i.e., an area near the loudspeaker), the first, second, and third modules 10, 95, and 100 may have a 120° horizontal coverage angle or a 90° horizontal coverage angle. In other embodiments, the modules have different horizontal coverage angles such as, for example, 60°, 150°, or any combinations thereof. The wider horizontal coverage angle near the top of the loudspeaker 90 provides the necessary acoustic coverage area for the rear of the room, while the narrower horizontal coverage angle near the bottom of the loudspeaker 90 provides the acoustic coverage required for the narrower portion of the room.

Figure 5:
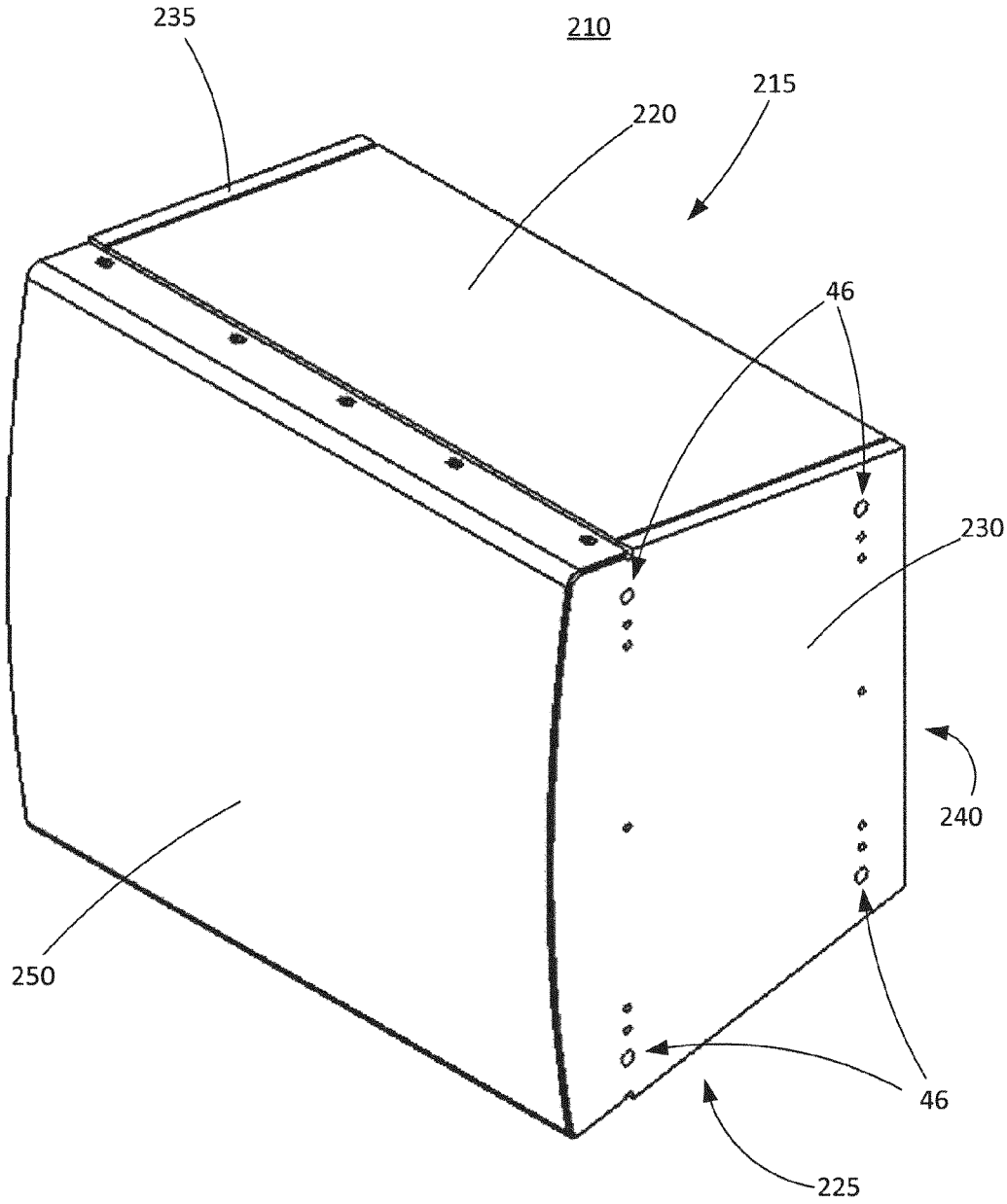
FIG. 5 is a perspective view of a near-field loudspeaker module according to an embodiment of the invention.
Figure 6:
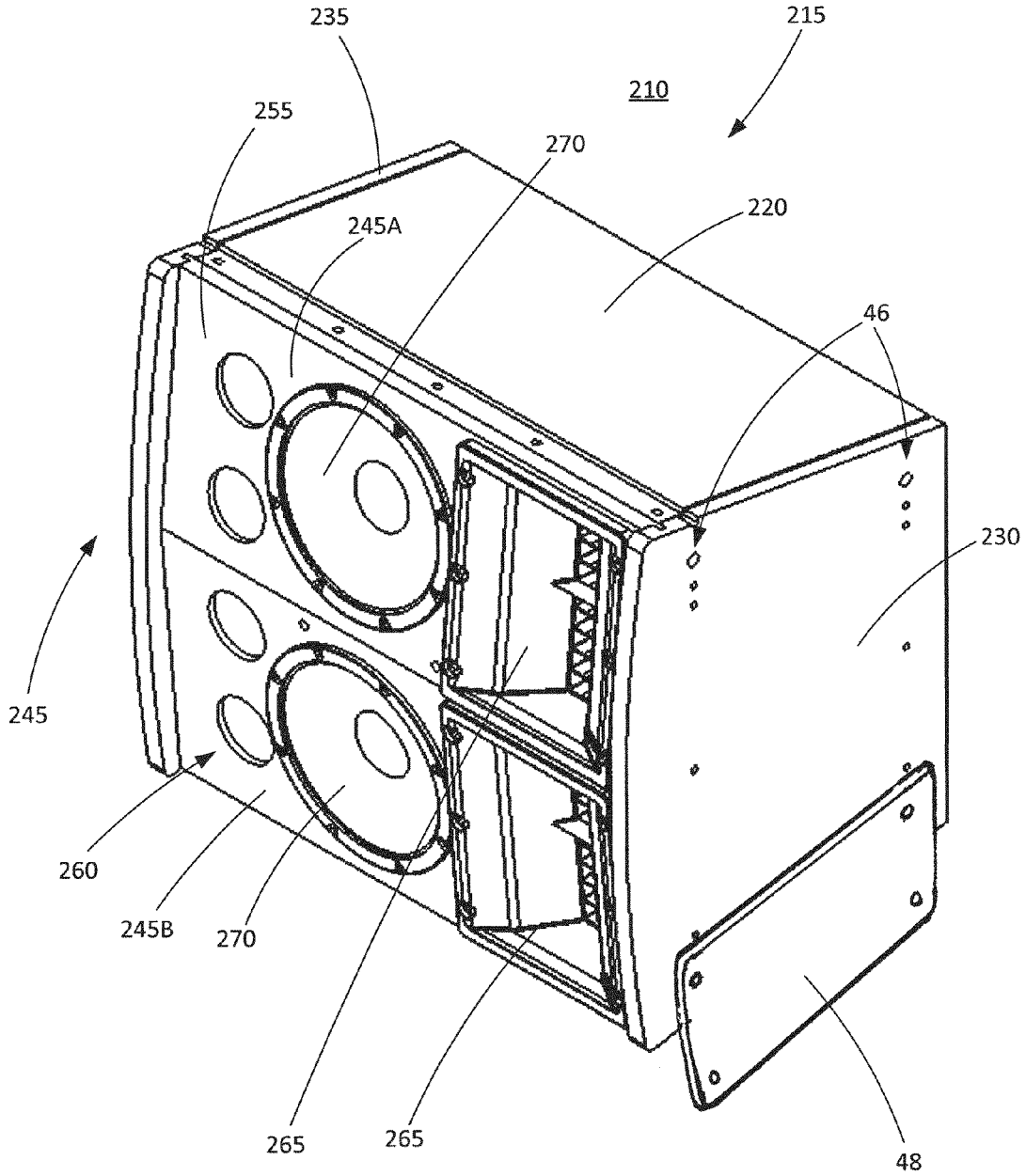
FIG. 6 is the near-field module of FIG. 5 with a speaker grille removed.

FIG. 5 illustrates a fourth line-array loudspeaker module 210 of a second loudspeaker module type that includes a module housing 215. The second loudspeaker module type is a near-field or short-throw loudspeaker module. Near-field modules are used to project sound to locations near the loudspeaker, such as the area near a stage in an auditorium or hall. The module housing 215 includes a top surface 220, a bottom surface 225, a right surface 230, a left surface 235, a rear surface 240, and a front surface 245 (see FIG. 5). The right surface 230 and the left surface 235 include a plurality of mounting points 46. The mounting points 46 are configured to receive bolts or other fasteners which are used to connect to a hanging assembly or a plurality of tie plates, such as tie plate 48 to the module housing 215. The tie plates 48 are configured to connect the fourth module 210 to additional loudspeaker modules. As noted above, the tie plates can be made from aluminum, steel, or similar materials. In some embodiments, the tie plates are concealed beneath cover plates (see FIG. 4) to provide a smooth and monolithic appearance to a loudspeaker (i.e., the modules are contiguous and transitions from one module to the next appear continuous). A speaker grille 250 is mounted to the front surface 245 of the fourth module 210. Like the grille 50, the grille 250 may be fixed to the housing with fasteners or removably connected to the housing 215.

Figure 7:
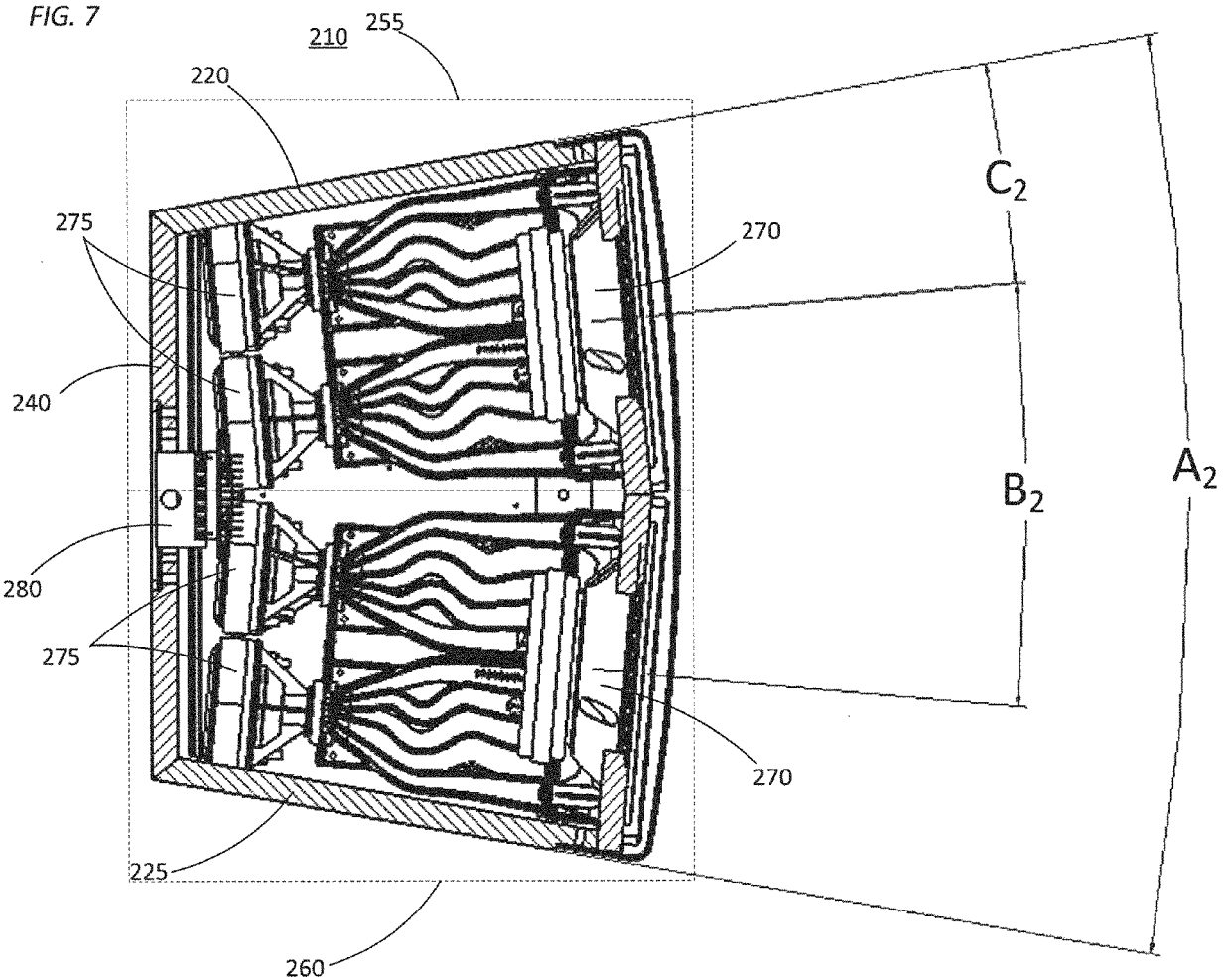
FIG. 7 is a side cross-sectional view of the near-field module of FIG. 5.

The fourth loudspeaker module 210 also includes a first element 255 and a second element 260. Each element includes a high-frequency driver or transducer assembly 265 and a low-frequency driver or transducer assembly 270. In some embodiments, each element also includes a mid-frequency driver or transducer assembly, an ultra-high-frequency driver or transducer assembly, and/or an ultra-low-frequency driver or transducer assembly. In other embodiments, each element includes, for example, a high-frequency transducer assembly and a mid-frequency transducer assembly, and the module includes a low-frequency transducer assembly which is common to the first and second elements. The high-frequency driver assembly 265 includes at least one compression driver or high-frequency transducer, and the low-frequency driver assembly 270 includes at least one woofer or low-frequency transducer. In the illustrated embodiment, the high-frequency assembly 265 includes two compression drivers 275 which are positioned symmetrically with respect to the top and bottom surfaces 220 and 225 of the module housing 215. In other embodiments, the high-frequency assembly includes a ribbon type transducer, a piezo array, or another dedicated high-frequency transducer or transducers. The high- and low-frequency assemblies 265 and 270 are positioned within the fourth module 210 and are mounted to first and second panels 245A and 245B, respectively, of the front surface 245. As illustrated in FIG. 7, the fourth module 210 also includes a crossover 280 positioned within the module housing 215 and adjacent to the rear surface 240. In other embodiments, the crossover 280 can be positioned at alternative locations within the module housing 215, such as adjacent to the top surface 220, the bottom surface 225, the right surface 230, or the left surface 235.

Figure 8:
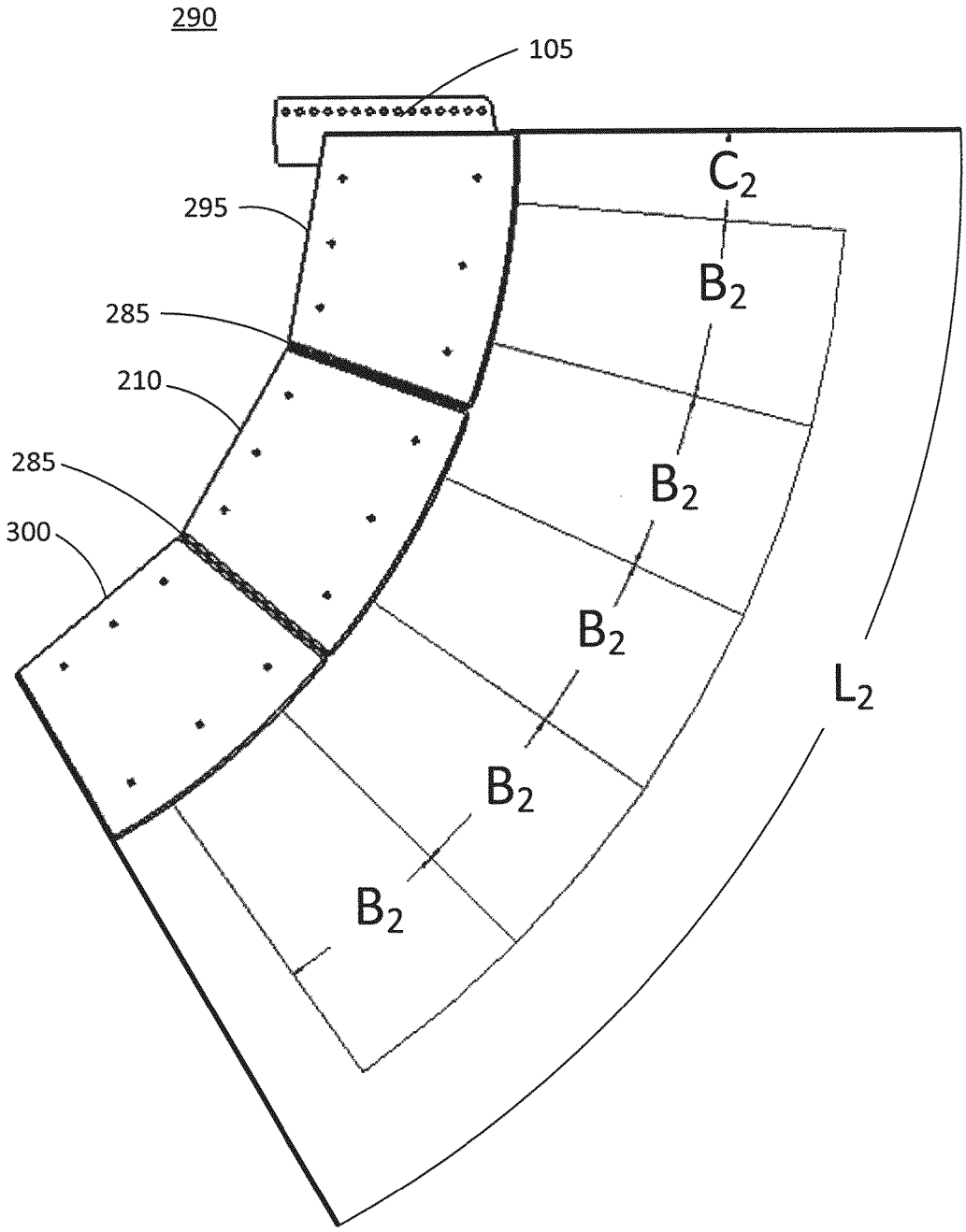
FIG. 8 is a side view of a plurality of near-field loudspeaker modules.

The fourth loudspeaker module 210 (i.e., a near-field module) includes a second included angle, $A_2$. In one embodiment, the second included angle, $A_2$, is twenty degrees ("20°"), and a second splay angle, $B_2$, is one-half of the second included angle, $A_2$, or ten degrees ("10°"). A second mounting angle, $C_2$, as illustrated in FIG. 7, has a value that is equal to one-half of the second splay angle, $B_2$ (e.g., 5°), and the first and second elements 255 and 260 are oriented symmetrically with respect to the top surface 220 and the bottom surface 225 of the module housing 215. The splay angles of the far-field modules are less than the splay angles of the near-field modules. The fourth module 210 also includes a horizontal coverage angle of, for example, 90° or 120°. In other embodiments, the fourth module 210 can have different horizontal coverage angles, such as 60°, 135°, or any combinations thereof The fourth loudspeaker module 210 is connected at second mating junctions 285 to additional loudspeaker modules of the second type (i.e., near-field modules) using the tie plates. In one embodiment of a loudspeaker 290 (FIG. 8), the fourth loudspeaker module 210 is connected to a fifth loudspeaker module 295 and a sixth loudspeaker module 300. The fifth and sixth loudspeaker modules 295 and 300 are each of the second type (e.g., near-field modules). As a result of the symmetrical orientation of the first and second elements of each module, the combination of the fourth, fifth, and sixth modules 210, 295, and 300 results in a uniform splaying individual elements throughout an overall vertical splay angle, $L_2$, (i.e., $L_2$ is equal to three $A_2$) for the loudspeaker 290. The second mounting angle, $C_2$, is equal to the angle between the center of the first element 255 and the hanging assembly 105. Accordingly, the splay angle is constant for the combination of the fourth, fifth, and sixth modules 210, 295, and 300. In some embodiments, each of the fourth, fifth, and sixth modules 210, 295, and 300 have the same horizontal coverage angle (e.g., 90°). In other embodiments, the horizontal coverage angles of the fourth, fifth, and sixth modules 210, 295, and 300 are varied to meet the acoustic requirements of a venue in a manner similar to that described above with respect to the loudspeaker 90 (FIG. 4).

Figure 9:
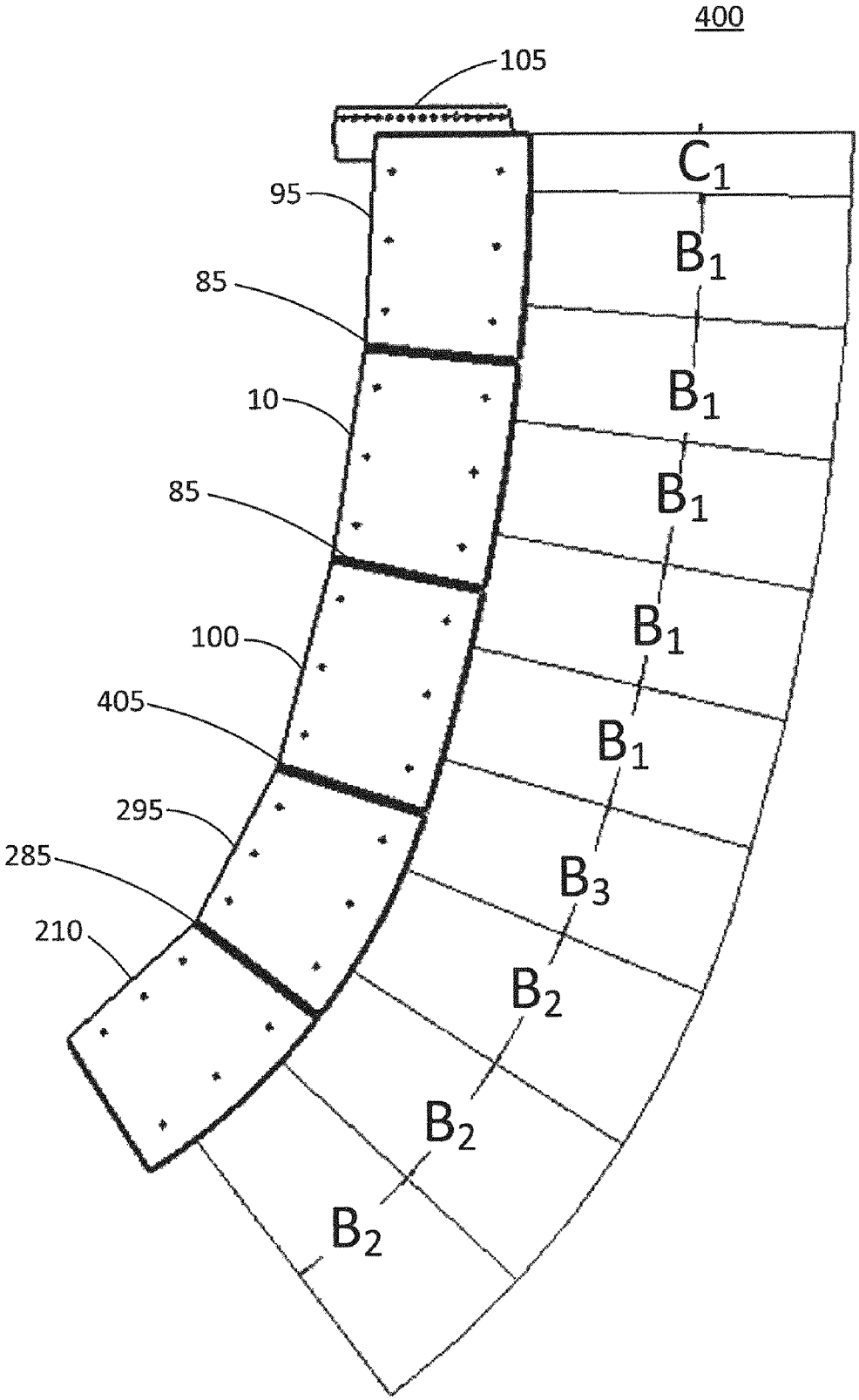
FIG. 9 is a side view of a combination of far-field and near-field loudspeaker modules.

FIG. 9 illustrates a line-array loudspeaker 400 that includes a combination of far-field and near-field loudspeaker modules. The illustrated loudspeaker 400 includes the first, second, third, fourth, and the fifth modules 10, 95, 100, 210, and 295 described above. The first module 10, second module 95, and third module 100 form a section of the loudspeaker 400 that is substantially similar to the loudspeaker 90 described above with respect to FIG. 4. The fourth module 210 and the fifth module 295 form a section of the loudspeaker 400 that is substantially similar to a portion of the loudspeaker 290 described above with respect to FIG. 8.

When the far-field modules and the near-field modules are contiguously connected as illustrated in FIG. 9, a third mating junction 405 between the third module 100 and the fifth module 295 forms a transitional third splay angle, $B_3$, between the first splay angle and the second splay angle. The third mating junction is formed from the combination of the third module 100, the fifth module 295, and the tie plates connecting the third and fifth modules 100 and 295. As a result of the first and second included angles, $A_1$ and $A_2$, and because the third and fifth modules 100 and 295 abut one another, the transition from the first splay angle, $B_1$, to the second splay angle, $B_2$, is angularly smooth and continuous (i.e., not abrupt). In some embodiments, the third splay angle is an intermediate splay angle (e.g., between the far-field and near-field modules) which is equal to a summation of the first mounting angle, $C_1$, and the second mounting angle, $C_2$. In the illustrated embodiment, the third splay angle, $B_3$, is equal to the sum of the first and second splay angles, $B_1$ and $B_2$, divided by two as shown below.

$$B_3 = \frac{B_1 + B_2}{2} = \frac{3^o + 10^o}{2} = 6.5^o$$

As such, instead of abruptly transitioning from a splay angle of 10° to a splay angle of 3°, a smooth and continuous angular transition is provided by the gradual or balanced angular progression from the 3° splay angle to the intermediate 6.5° splay angle to the 10° splay angle. A true line-array is able to provide a uniform sound pressure level ("SPL") from the front of a listening space to a rear of the listening space. An abrupt transition or discontinuity between a far-field module that has a narrow vertical splay angle and a near-field module that has a wide vertical splay angle results in an area of low (or lower) SPL and poor intelligibility, which reduces the effective performance of the line-array. The intermediate splay angle provides for a uniform SPL throughout the listening area.

The arrangement and grouping of the modules, the elements within each module, and the high and low frequency assemblies within each element, also provide a flatter frequency response through the passband of the line-array 400 and improve the sonic quality and sound pressure of the acoustic outputs of the line-array 400. In other embodiments, different combinations of far-field and near-field modules can be used to meet the acoustic requirements of a venue.

In other embodiments of the invention, additional modules with different included angles, splay angles, and mounting angles can be connected to create a line-array loudspeaker. For example, an ultra-far field module with a splay angle of, for example, two degrees ("2°") can be connected to the top portion of the line-array, and an ultra-near field module with a splay angle of, for example, fifteen degrees ("15°") can be connected to the bottom portion of the line-array. The additional modules enable the line-array to provide a more uniform coverage area for a particular venue. The ultra-far field module provides a more uniform coverage area near the back of a venue, and the ultra-near field module provides a more uniform coverage area near the front of a venue. The additional modules can be connected in a manner similar to that described above with respect to the far field and near field modules.

Figure 10:
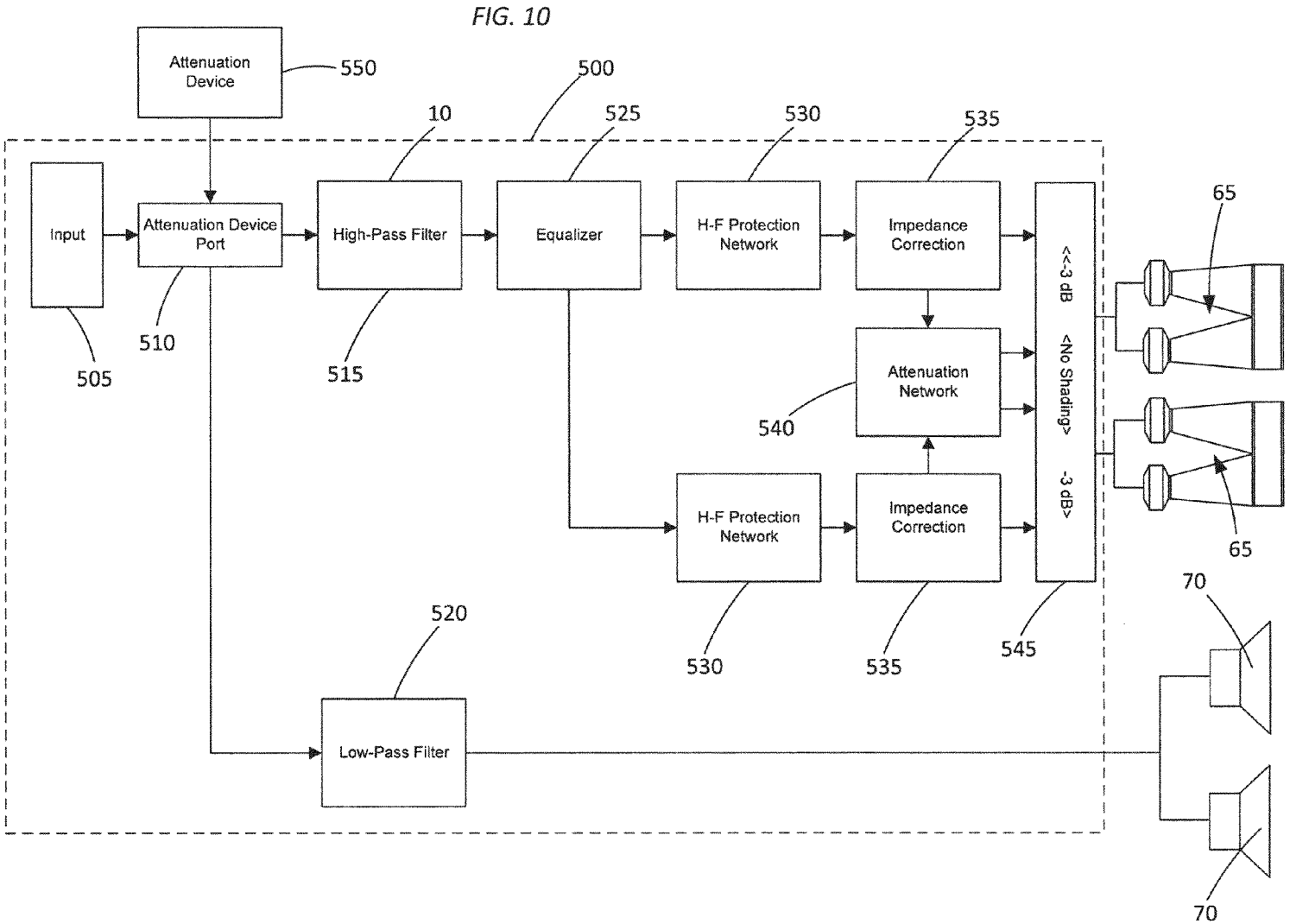
FIG. 10 is a block diagram of a crossover circuit according to an embodiment of the invention.

FIG. 10 is a block diagram of a crossover circuit 500 which is similar to crossovers 80 and 280 shown in FIGS. 3 and 7. The crossover 500 includes a filter network that separates an electrical signal received from an audio source (e.g., an amplified signal from a mixing console, audio power amplifier, or other source) into two or more signals within predetermined frequency bandwidths before sending the signals to the high- and low-frequency assemblies 65 and 70. The crossover circuit divides or separates the electrical signal into frequency bands. For example, the crossover circuit divides the electrical signal into a high-frequency band and a low-frequency band. The high-frequency band of the electrical signal is sent to the high-frequency assembly 65 and the low-frequency band is sent to the low-frequency assembly 70.

The crossover circuitry can be passive or active. A passive crossover circuit is constructed from passive components such as resistors, inductors, and capacitors to create one or more passive filters. An active crossover circuit is constructed with active components such as, for example, operational amplifiers or other components which require a power source. An active crossover circuit requires, in many instances, a power amplifier for each output frequency band. For example, if the speaker includes a low-frequency transducer and a high-frequency transducer, a power amplifier is included for both the high-frequency band and the low-frequency band outputs of the crossover circuit. The power amplifiers are positioned between the crossover circuit and the high and low-frequency transducers.

The crossover 500 illustrated in FIG. 10 is a passive crossover. Unlike conventional passive crossovers which often only include high- and low-pass filtering, the crossover 500 includes, among other things, an input section 505, an attenuation device port 510, a high-pass filter 515, a low-pass filter 520, an equalizer 525, high-frequency protection networks 530, impedance correction modules or circuits 535, an attenuation network 540, and a switch selectable shading module 545. In some embodiments, the crossover is a high-order (e.g., at least fourth order) passive crossover which provides, for example, at least 24 decibels/octave of attenuation. In other embodiments, the crossover is a higher or lower order crossover and provides a different amount of attenuation. The crossover 500 is coupled to high-frequency assemblies 65 and low-frequency assemblies 70. Electrical signals received at the input section 505 are fed through the attenuation device port 510. The attenuation device port 510 is selectively coupled to an attenuation device 550 to provide attenuation of an entire loudspeaker module to improve the acoustic performance of a line-array, such as line-array 400. For example, the attenuation device 550 allows for multiple drive-level zones to be created within the line-array 400 without requiring additional amplifiers or signal processing. As such, a multi-zoned line-array can be powered from a single amplifier channel. The electrical signals from the attenuation device port 510 are sent to the high-pass filter 515 and the low-pass filter 520. The low-pass filter 520 filters out the high-frequency portions of the input electrical signals to generate filtered low-frequency signals. The filtered low-frequency signals are sent to the low-frequency assemblies 70.

The high-pass filter 515 filters out the low-frequency signals to generate filtered, high-frequency signals. The filtered high-frequency signals are sent to the equalizer 525 to shape the frequency response for line-array applications. The high-frequency protection networks 530 include, for example, a current limiter, compressor, fuse, heat sensitive resistor, or the like to provide protection to the loudspeaker 400 at high-frequencies (e.g., to prevent high-frequency driver failure). The outputs of the high-frequency protection networks 530 are sent to impedance correction modules or circuits 535 to correct impedance variations which occur with changes in frequency. The attenuation network 540 matches the level of the filtered, high-frequency signals to the level of the filtered, low-frequency signals at the crossover frequency. Output signals from the impedance correction circuits 535 and the attenuation network 540 are sent to the shading module 545. In the shading module 545, the high-frequency signals of the first or second element of each module can be selectively reduced or shaded by, for example, 3 dBs. In other embodiments, the shading module 545 can provide different or variable shading levels (e.g., 6 dBs or 3-6 dBs of shading). The selective shading provided by the shading module 545 allows a user to shape the acoustic output (e.g., sound waves) and wavefront from the line-array 400 without requiring additional amplifier channels. Output signals from the shading module 545 are sent to the high-frequency assemblies 65 of each element. The crossover 500 provides signal conditioning of a full bandwidth signal from the amplifier to produce acoustic outputs or sound waves from the high-frequency assemblies 65 and the low-frequency assemblies 70 (e.g., acoustic outputs of each high- and low-frequency driver assembly in an element) which are radiated as a coherent wavefront (i.e., the acoustic outputs of each driver assembly are in phase (e.g., planewaves)). In some embodiments, the crossovers located in each of a plurality of modules are operable to couple each acoustic output of each of the plurality of modules into a coherent wavefront.

Thus, the invention provides, among other things, a line-array loudspeaker that can be assembled to meet the acoustic requirements of a venue. The line-array includes a combination of far-field loudspeaker modules and near-field loudspeaker modules which are selectively fixedly connected to each other. Each module includes a first element, a second element, and a single high-order passive crossover. Each of the first and second elements includes a high-frequency driver assembly and a low-frequency driver assembly. The far-field modules have a first included angle and a first splay angle. The near-field modules have a second included angle and a second splay angle. The far-field modules and the near-field modules are contiguously connected using a rigging system to provide a smooth and continuous transition from the first splay angle to the second splay angle. Each of the high-frequency driver assemblies and low-frequency driver assemblies is driven by a single or first amplifier channel to produce a coherent wavefront. Various features and advantages of the invention are set forth in the following claims.

What is claimed is:

1. A modular line-array loudspeaker, the loudspeaker comprising:

a first loudspeaker module of a first type including a first loudspeaker element, a second loudspeaker element, and a first crossover circuit, wherein the first loudspeaker module has a first fixed included angle and a first splay angle; and a second loudspeaker module of a second type including a third loudspeaker element, a fourth loudspeaker element, and a second crossover circuit, wherein the second loudspeaker module has a second fixed included angle and a second splay angle;

wherein each of the first, second, third, and fourth loudspeaker elements includes a low-frequency driver assembly and a high-frequency driver assembly, wherein the high- and low-frequency driver assemblies of the first and second loudspeaker elements and the high- and low-frequency driver assemblies of the third and fourth loudspeaker elements are each driven by a first amplifier channel; and wherein a transition from the first fixed included angle to the second fixed included angle is continuous.

2. The loudspeaker of claim 1, wherein the first crossover circuit and the second crossover circuit are high-order passive crossover circuits.

3. The loudspeaker of claim 1, wherein the first type of loudspeaker module is a far-field loudspeaker module, and the second type of loudspeaker module is a near-field loudspeaker module.

4. The loudspeaker of claim 1, wherein the low-frequency driver assembly includes a woofer and the high-frequency driver assembly includes a compression driver.

5. The loudspeaker of claim 1, wherein the first splay angle is less than the second splay angle.

6. The loudspeaker of claim 1, wherein at least one of the first, second, third, and fourth loudspeaker elements is selectively attenuatable.

7. The loudspeaker of claim 1, wherein the low-frequency driver assembly includes a low-frequency transducer and the high-frequency driver assembly includes a high-frequency transducer.

8. The loudspeaker of claim 1, wherein the first fixed included angle and the second fixed included angle include trapezoidal angles.

9. The loudspeaker of claim 1, further comprising a rigging assembly configured to contiguously couple the first module to the second module.

10. The loudspeaker of claim 1, further comprising tie plates configured to connect the first module to the second module.

11. The loudspeaker of claim 1, wherein each of the first, second, third, and fourth loudspeaker elements includes a mid-frequency driver assembly, an ultra-low-frequency driver assembly, and an ultra-high-frequency driver assembly.

12. The loudspeaker of claim 1, wherein the high-frequency driver assembly includes a ribbon type transducer or a piezo array.

13. The loudspeaker of claim 1, wherein the first splay angle is an angle between respective radiated acoustic centers of a first front panel and a second front panel of the first and the second loudspeaker elements.

14. The loudspeaker of claim 1, wherein the first loudspeaker module has a first mounting angle that is less than the first slay angle.

15. The loudspeaker of claim 1, further comprising a first mating junction configured to couple the first loudspeaker module to the second loudspeaker module.

16. The loudspeaker of claim 1, wherein the first loudspeaker module has a horizontal coverage angle.

17. The loudspeaker of claim 1, wherein the first crossover circuit and the second crossover circuit are active crossover circuits.

* * * * *